US007686897B2

(12) United States Patent
Kidani et al.

(10) Patent No.: US 7,686,897 B2
(45) Date of Patent: Mar. 30, 2010

(54) MARTENSITIC STAINLESS STEEL SEAMLESS PIPE AND A MANUFACTURING METHOD THEREOF

(75) Inventors: Shigeru Kidani, Kainan (JP); Mutsumi Tanida, Wakayama (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 887 days.

(21) Appl. No.: 11/030,107

(22) Filed: Jan. 7, 2005

(65) Prior Publication Data

US 2005/0115647 A1 Jun. 2, 2005

Related U.S. Application Data

(63) Continuation of application No. PCT/JP03/08625, filed on Jul. 7, 2003.

(30) Foreign Application Priority Data

Jul. 15, 2002 (JP) ..... 2002-206169

(51) Int. Cl.
*C22C 38/00* (2006.01)
*C22C 38/18* (2006.01)
*C21D 9/08* (2006.01)

(52) U.S. Cl. ..... 148/325; 420/34; 148/592

(58) Field of Classification Search ..... 148/325, 148/592; 420/34
See application file for complete search history.

(56) References Cited

U.S. PATENT DOCUMENTS 4,470,282 A * 9/1984 Hayashi ..... 72/97
5,873,960 A * 2/1999 Kondo et al. ..... 148/593
2001/0001966 A1* 5/2001 Tanida et al. ..... 148/325
2003/0127162 A1 7/2003 Kidani et al.

FOREIGN PATENT DOCUMENTS

EP 0 178 334 4/1986

(Continued)

OTHER PUBLICATIONS

Joseph R. Davis, ASM Handbook—Embrittlement of Steels, 1990, ASM International, 10th Edition, vol. 1, 711.*
H. Li, et al., "Effect of Internal Hydrogen on the Mixed-Mode I/III Fracture, Toughness of a Ferritic/Martensitic Stainless Steel", Hydrogen Effects in Materials, Proceedings of the Int'l. Conference on the Effect of Hydrogen on Behavior of Materials, Sep. 11-14, 1994, pp. 843-853.

(Continued)

*Primary Examiner*—Roy King
*Assistant Examiner*—Caitlin Fogarty
(74) *Attorney, Agent, or Firm*—Clark & Brody

(57) ABSTRACT

The present invention provides a martensitic stainless steel seamless pipe and a method of making, wherein the pipe has minimal inner surface defects and prevents delayed fracture generation in the impact-worked portions. The pipe comprises C: 0.15 to 0.22%, Si: 0.1 to 1.0%, Mn: 0.10 to 1.00%, Cr: 12.00 to 14.00%, P: 0.020% or less, S: 0.010% or less, N: 0.05% or less, O(Oxygen): 0.0060% or less, at least one alloying element selected from V, Nb and Ti of 0.005 to 0.200% and B of 0.0005 to 0.0100%, and the balance Fe and impurities, wherein either the following inequalities (1), (2), (4) and (5) or the following inequalities (1), (3), (4) and (5) are satisfied:

$$C^*+10N^* \leqq 0.45, \quad (1)$$

$$H1 \leqq -0.003(C^*+10N^*)+0.0016, \quad (2)$$

$$H2 \leqq -0.0018(C^*+10N^*)+0.00096, \quad (3)$$

$$Cr^* \leqq 9.0, \quad (4)$$

$$S \leqq 0.088N^*+0.00056, \quad (5).$$

6 Claims, 6 Drawing Sheets

FOREIGN PATENT DOCUMENTS

| | | | | |
|---|---|---|---|---|
| EP | 0 472 305 | A1 | | 2/1992 |
| EP | 1 099 772 | A1 | | 5/2001 |
| JP | 4-210453 | | | 7/1992 |
| JP | 04210453 | A | * | 7/1992 |
| JP | 5-171361 | | | 7/1993 |
| JP | 05171361 | A | * | 7/1993 |
| JP | 5-255734 | | | 10/1993 |
| JP | 6-306551 | | | 11/1994 |
| JP | 7-109522 | | | 4/1995 |
| JP | 07109522 | A | * | 4/1995 |
| JP | 8-120415 | | | 5/1996 |
| JP | 9-310121 | | | 12/1997 |
| JP | 2002-060909 | | | 2/2002 |

OTHER PUBLICATIONS

T. Boellinghaus et al., "Numerical Model for Hydrogen-Assisted Cracking", *Corrosion* vol. 56, No. 6, Jun. 2000, pp. 611-623.

M. Nebhnani et al., "Failure of a martensitic stainless steel pipe weld in a fossil fuel power plant", *Engineering Failure Analysis* vol. 9, 2002, pp. 277-286.

* cited by examiner

MARTENSITIC STAINLESS STEEL SEAMLESS PIPE AND A MANUFACTURING METHOD THEREOF

This application is a continuation of International Patent Application No. PCT/JP03/08625, filed Jul. 7, 2003.

TECHNICAL FIELD

The present invention relates to a martensitic stainless steel seamless pipe, such as a pipe for an oil well, which ensures no generation of cracks resulting from a delayed fracture. The present invention also relates to a method for manufacturing such a martensitic stainless steel pipe without any generation of inner surface defects such as internal scabs.

BACKGROUND ART

A martensitic stainless steel such as API-13% Cr, which is used as a pipe for an oil well, normally includes a carbon content of about 0.2%, which needs a high yield strength of 80 ksi (552 MPa) or more and a hot workability. Due to a high C and Cr content, an as-rolled stainless steel pipe has an extreme hardness, therefore has a reduced toughness. Consequently, an as rolled conventional martensitic stainless steel pipe might have a crack resulting from a delayed fracture in "the impact-worked portion", where an impact load or static load was worked before a heat treatment. Accordingly, it is necessary to restrict the piling height in "a rack" and/or the dropping height into a rack of the steel pipes during transportation or storage. Moreover, the stand-by time before a heat treatment after hot-rolling must be shortened.

The above-mentioned restrictions during transportation or storage could result in various disadvantages such as a large stockyard because of the restriction of the piling height and/or the dropping height of pipes, a reduction in working efficiency resulting from the careful handling of the steel pipes without excessive loading impact and a restricted time schedule from hot rolling to a heat treatment in order to finish the heat treatment within a restricted working period.

Japanese Patent Unexamined Publication No. H8-120415 discloses a martensitic stainless steel having a restricted N content. In this patent specification, only the improvement of toughness after a heat treatment is described. However, neither the relationship between the N content and a delayed fracture in the impact-worked portions of an as-rolled steel pipe nor the measures for suppressing such inner surface defects as internal scabs due to poor hot workability resulting from the decreased N content is described. It is not practical to manufacture a seamless steel pipe without any measures to suppress internal scabs.

Japanese Patent Unexamined Publication No. H6-306551 discloses an invention, in which the hydrogen content is restricted to improve the toughness in the heat affected zone by welding of a martensitic stainless steel pipe having low carbon content. Furthermore, Japanese Patent Unexamined Publication No. H5-255734 describes an invention of dehydrogenating a martensitic stainless steel having low carbon content in order to prevent a delayed fracture. These inventions deal with a martensitic stainless steel having low carbon content. However, no description is given regarding the relationship between the hydrogen content and a delayed fracture in the impact-worked portions of an as-rolled martensitic stainless steel pipe containing such high C of about 0.2%.

DISCLOSURE OF INVENTION

It is the primary objective of the present invention to provide a martensitic stainless steel pipe, containing C of about 0.2%, which suppresses a delayed fracture in the impact-worked portions before a heat treatment after rolling, and also generates no internal scab.

It is a second objective of the present invention to provide a method for manufacturing a martensitic stainless steel pipe, without an internal scab generation, which suppresses a delayed fracture in the impact-worked portions before a heat treatment after rolling.

The present inventors have attained the first objective by restricting the correlation of the contents of C (carbon), H (hydrogen), N (nitrogen) and S (sulfur) in addition to specifying the contents of various elements in steel properly.

Moreover, the present inventors have attained the second object by specifying the condition to roll a steel pipe.

The present invention is characterized by the following martensitic stainless steel (A) and the following method (B) for manufacturing martensitic stainless steel. In this specification, "%" implies "mass %" regarding a content of each element. Furthermore, "as-rolled pipe" means a pipe which is formed by a hot rolling and to which a heat treatment has not been applied yet.

(A) A martensitic stainless steel seamless pipe, characterized by consisting of, by mass %, C: 0.15 to 0.22%, Si: 0.1 to 1.0%, Mn: 0.10 to 1.00%, Cr: 12.00 to 14.00%, P: 0.020% or less, S: 0.010% or less, N: 0.05% or less, 0 (Oxygen): 0.0060% or less, Al: 0 to 0.1%, Ni: 0 to 0.5%, Cu: 0 to 0.25%, Ca: 0 to 0.0050% and at least one alloying element selected from at least one group of those mentioned below (totally 0.005 to 0.200 mass % in case of including two or more kinds of these alloying elements), and the balance Fe and impurities:

The first group: V, Nb and Ti of 0.005 to 0.200 mass %, respectively,

The second group: B of 0.0005 to 0.0100 mass %, and is also characterized by satisfying either of the following inequalities (1), (2), (4) and (5) or the following inequalities (1), (3), (4) and (5):

$$C^*+10N^* \leqq 0.45, \quad (1)$$

$$H1 \leqq -0.003(C^*+10N^*)+0.0016, \quad (2)$$

$$H2 \leqq -0.0018(C^*+10N^*)+0.00096, \quad (3)$$

$$Cr^* \leqq 9.0, \quad (4)$$

$$S \leqq 0.088N^*+0.00056, \quad (5)$$

where C* is an effective solute carbon content (mass %) defined by the following equation (6), N* is an effective solute nitrogen content (mass %) defined by equation (7), and Cr* is a Cr equivalent defined by equation (8), H1 of inequality (2) is the amount (mass %) of residual hydrogen in an as-rolled steel pipe, and H2 of inequality (3) is the amount (mass %) of residual hydrogen in the steel pipe after a heat treatment, and a symbol of an element in each equation or inequality is a content (mass %) of the respective element:

$$C^*=C-[12\{(Cr/52)\times(6/23)\}/10], \quad (6)$$

$$N^*=N-[14\{(V/51)+(Nb/93)\}/10]-[14\{(Ti/48)+(B/11)+(Al/27)\}/2], \quad (7)$$

$$Cr^*=Cr+4Si-(22C+0.5Mn+1.5Ni+30N) \quad (8)$$

Furthermore, it is preferable that the steel pipe wherein has a C content of 0.18 to 0.21%, a Si content of 0.20 to 0.35%, a Cr content of 12.40 to 13.10%, a S content of 0.003% or less, and a N content of 0.035% or less.

(B) A method for manufacturing a martensitic stainless steel seamless pipe, characterized by pierce-rolling a stainless steel with an inclined roller type piercing mill under conditions of satisfying the inequality (9) below, which consists of, by mass %, C: 0.15 to 0.22%, Si: 0.1 to 1.0%, Mn: 0.10 to 1.00%, Cr: 12.00 to 14.00%, P: 0.020% or less, S: 0.010% or less, N: 0.05% or less, O (Oxygen): 0.0060% or less, Al: 0 to 0.1%, Ni: 0 to 0.5%, Cu: 0 to 0.25%, Ca: 0 to 0.0050% and at least one alloying element selected from at least one group of those mentioned below (totally 0.005 to 0.200 mass % in case of including two or more kinds of these alloying elements), and the balance Fe and impurities:

The first group: V, Nb and Ti of 0.005 to 0.200 mass %, respectively.

The second group: B of 0.0005 to 0.0100 mass %.

and which also satisfies all the following inequalities (1), (4) and (5):

$$C^*+10N^* \leqq 0.45, \quad (1)$$

$$Cr^* \leqq 9.0, \quad (4)$$

$$S \leqq 0.088N^*+0.00056, \quad (5)$$

$$Cr^* < 0.00009(C.A.+F.A.)^3-0.0035(C.A.+F.A.)^2+0.0567(C.A.+F.A.)+8.0024 \quad (9)$$

wherein C* is an effective solute carbon content (mass %) defined by the following equation (6), N* is an effective solute nitrogen content (mass %) defined by equation (7), and Cr* is a Cr equivalent defined by equation (8), C.A. and F.A. in inequality (9) express a toe angle and a feed angle, respectively, a symbol of an element in each equation or inequality represents a content (mass %) of the respective element:

$$C^* = C-[12\{(Cr/52)\times(6123)\}/10], \quad (6)$$

$$N^* = N-[14\{(V/51)+(Nb/93)\}/10]-[14\{(Ti/48)+(B/11)+(A/27)\}/2], \quad (7)$$

$$Cr^* = Cr+4Si-(22C+0.5Mn+1.5Ni+30N). \quad (8)$$

Furthermore, it is preferable that the steel pipe wherein has a C content of 0.18 to 0.21%, a Si content of 0.20 to 0.35%, a Cr content of 12.40 to 13.10%, a S content of 0.003% or less, and a N content of 0.035% or less, and also that method for manufacturing the martensitic stainless steel seamless pipe comprises the following steps (10) and (11) after pierce-rolling:

(10) soaking a pipe at a temperature 920° C. or more,

(11) carrying out the hot rolling.

BEST MODE FOR CARRYING OUT THE INVENTION

Figure 1:
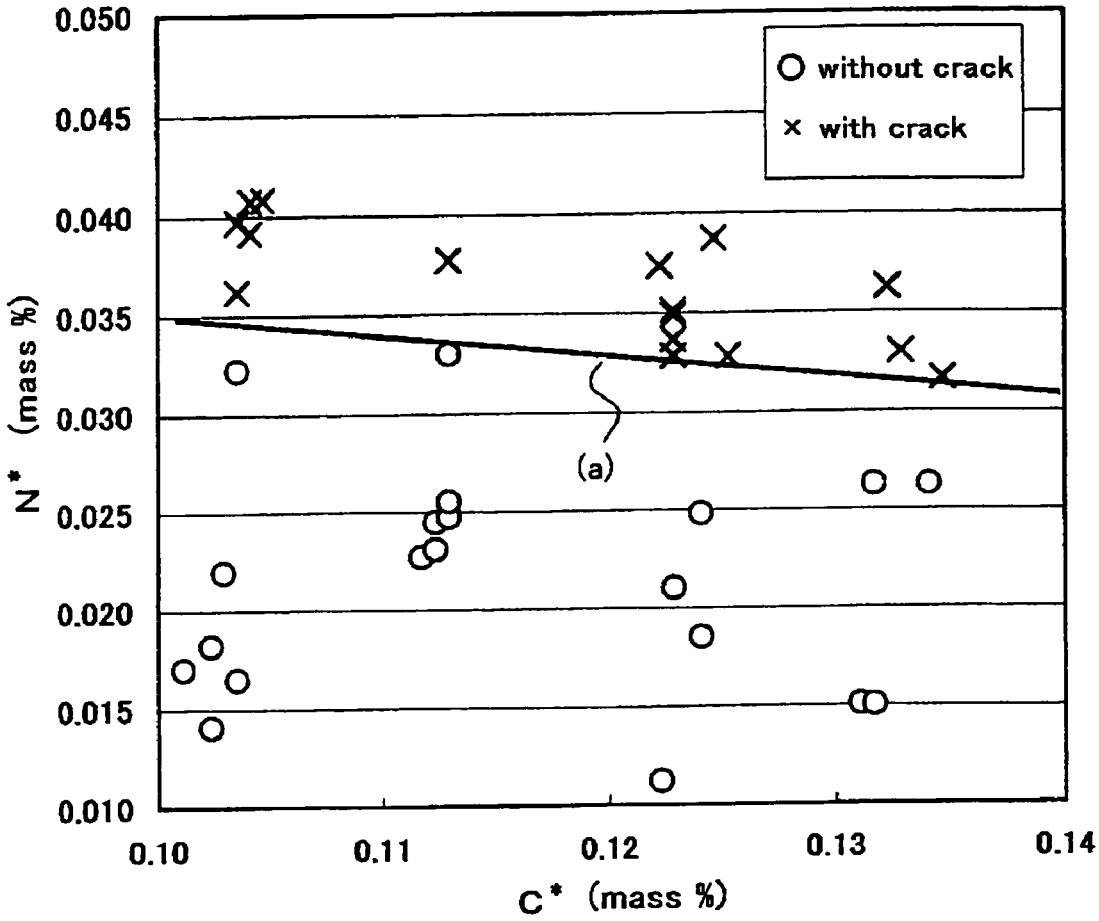
FIG. 1 is a diagram showing the relationship between a crack resulting from a delayed fracture and two parameters: the effective solute carbon content (C*) and the effective solute nitrogen content (N*).

The present inventors assumed that a delayed fracture of the impact-worked portions in a martensitic stainless steel depends on the amounts of solute C (carbon), solute N (nitrogen) and solute H (hydrogen), which are interstitial elements. Following many experiments and the following facts (a) to (d) were confirmed:

(a) Sensitivity of a delayed fracture in the impact-worked portions of an as-rolled steel pipe depends upon the amount of both solute C and solute N, and especially upon that of solute N.

(b) The amount of solute C strongly influences the mechanical strength after a heat treatment, whereas the amount of solute N has less influence on it. However, N provides a remarkable reduction in the delayed fracture resistance for the impact-worked portions of an as-rolled steel pipe.

(c) When the N content is decreased in order to enhance the delayed fracture resistance for the impact-worked portions of an as-rolled steel pipe, the austenite structure becomes unstable at a high temperature, which causes numerous internal scabs during the manufacturing of the pipe because of poor hot workability. Therefore, it is necessary to suppress scabs.

(d) In order to solve this problem, a piercing angle (toe angle) and a feed angle for the piercing mill is specified, according to the contents of the austenite generating elements and the ferrite generating elements in order to minimize the amount of work strain in the material. Thus, this procedure makes it possible to prevent an internal scab.

Various conditions, such as the chemical composition of the steel pipe and the manufacturing method, according to the present invention, will be explained in detail below.

1. Chemical Composition of Steel Pipe

The chemical composition of the martensitic stainless steel pipe according to the invention is determined as follows.

C:

C provides a solid-solution hardening of an as-rolled steel pipe together with N. The content of C should be 0.22% or less, and is preferably 0.21% or less, in order to suppress the delayed fracture of the impact-worked portions by the solid-solution hardening. However, such a reduced C content makes it difficult to attain the aimed mechanical strength after a heat treatment. Moreover, an excessive reduction in the C content causes internal scabs generated after making a steel pipe due to δ-ferrite since C is an austenite-generating element. Accordingly, the content of C should be 0.15% or more, and the content of effective solute C should satisfy the inequality (1) above. The reason for this will be explained later. It is preferable that the C content is 0.18% or more.

Si:

Si is added as deoxidant during steel making. A content of less than 0.1% provides no effect on deoxygenating whereas more than 1.0% causes a low toughness. Accordingly, the content should be 0.1 to 1.0%. A preferable content is 0.75% or less in order to obtain a high toughness. A more preferable content is 0.20 to 0.35%.

Mn:

Mn is an element effective for enhancing the mechanical strength of steel, and is added as a deoxidant during steel making. In addition, it fixes the S in steel by forming MnS, and causes a good hot workability. A content of less than 0.10% provides no effect on a hot workability, whereas more than 1.00% causes a low toughness. Accordingly, the content should be 0.1 to 1.0%. It is preferable that the Mn content is 0.7% or less.

Cr:

Cr is a basic element for enhancing a corrosion resistance of steel. In particular, a content of more than 12.00% improves a corrosion resistance for a pitting, and further greatly enhances a corrosion resistance under a $CO_2$ environment. On the other hand, because Cr is a ferrite-generating element, the Cr content of more than 14.00% is apt to generate δ ferrite in the process at a high temperature, causing a reduced hot workability. Moreover, an excessive Cr content results in high cost of production. Accordingly, the content should be 12.00% to 14.00%, and is more preferably 12.40% to 13.10%.

P:

P is an impurity contained in steel. An excessive P content causes a low toughness of products after a heat treatment. An allowable upper limit of the P content should be 0.020%. It is preferable to minimize the P content as small as possible.

S:

Because S is an impurity that decreases a hot workability, the S content should be minimized. An allowable upper limit of the S content is 0.010%. The S content should satisfy the inequality (5) above. It is preferable that the S content is 0.003% or less.

N:

N is an austenite-stabilizing element that improves the hot workability of steel. However, N causes a delayed fracture in the impact-worked portions of an as-rolled steel pipe. Accordingly, the upper limit of the N content should be 0.05%. The reduction in a hot workability resulting from a decreased N content is compensated by other elements, so that the N content should be minimized. It is preferable that the N content is 0.035% or less.

O (oxygen):

In case of an incomplete deoxygenating during the steel making process, the number of cracks or streaks on the surface of a billet are increased and an external scabs are generated in a hot-rolled steel. Accordingly, the content of 0 should be minimized to be 0.0060% or less.

V, Ti, Nb and B:

These elements combine with N to form nitrides. An inclusion of more than one selected from these elements provides a reduced the number of solute N solubility as if N content is decreased. However, an excessive N content causes extremely high hardness by the nitrides formed after a heat treatment and results in a reduction of a corrosion resistance and toughness. Accordingly, the V, Ti or Nb content should be 0.005 to 0.200%, respectively, and the B content should be 0.0005 to 0.0100%. The total content of these elements should be 0.005 to 0.200% in case of including two or more kinds of these alloying elements.

Al, Ni, Cu and Ca

These elements can be included if necessary. The numerical value "0" in the content for one of the elements implies that the element is not intentionally added into the steel.

Al:

Al can be added when deoxygenating during the steel making process and is effective for suppressing an external scab in a steel pipe. However, an excessive Al content causes a reduced cleanness of steel and also causes clogging of an immersion nozzle in the process of a continuous casting. Accordingly, it is preferable that the Al content is 0 to 0.1%.

Ni:

Ni is an austenite-stabilizing element and improves the hot workability of steel. However, an excessive Ni content causes a reduced sulfide stress corrosion cracking resistance. Accordingly, it is preferable that the Ni content is 0 to 0.5%.

Cu:

Cu is effective for enhancing corrosion resistance and is an austenite-stabilizing element to improve the hot workability of steel. However, Cu has a low melting point, and an excessive Cu content causes a reduced hot workability. Accordingly, it is preferable that the Cu content is 0 to 0.25%.

Ca:

Ca combines with S in steel and prevents a sulfur segregation in grain boundaries, which caused a reduced hot workability. However, an excessive Ca content causes macro-streak-flaws. Accordingly, it is preferable that the Ca content is 0 to 0.0050%.

2. As for Inequalities (1) to (5)

First, the inequality (1) will be described. In order to suppress cracks in the impact-worked portions, it is necessary to improve the delayed fracture resistance. An interstitial element such as C and N enhances the mechanical strength of steel, but it deteriorates the delayed fracture resistance in the impact-worked portions. In an as-rolled steel pipe, there remains a residual stress resulting from a hot rolling by a sizing mill or a stretch reducing mill, which reduces a delayed fracture resistance more.

The present inventors studied the effect of C and N on a delayed fracture in the impact-worked portions of an as-rolled API-13% Cr steel pipe. In a delayed fracture test, an impact load was applied to the steel pipes whose conditions will be described in "EXAMPLES". The results are shown in FIG. 1 and Tables 1 to 4, in which an effective solute carbon content (C*) and an effective solute nitrogen content (N*) were used. The reason for using C* and N* is described below.

Some of C atoms combine with Cr atoms to form carbides. The content of C, acting as an interstitial element, can be obtained by subtracting the content of C in the carbide from the total content of C. Accordingly, an effective solute carbon content (C*) is defined by the equation (6).

Similarly, some of N atoms combine with V, Nb, Ti, B and Al atoms to form nitrides. The content of N, acting as an interstitial element, can be obtained by subtracting the content of N in the nitride from the total content of N. Accordingly, an effective solute nitrogen content (N*) is defined by the equation (7). In the equation (7), a coefficient of 1/10 is applied for Nb and V nitrides because of the lower precipitation temperature and a coefficient of ½ for Ti, B and Al nitrides because of the higher precipitation temperature.

Both C and N are interstitial elements in steel. If they have the same content, they provide approximately the same influence on the mechanical strength and the hardness. However, the content of C is restricted within a range of 0.18 to 0.21% in a 13% Cr martensitic stainless steel seamless pipe specified in the API-L80 grade, which is used for oil well. On the contrary, if the content of N is restricted only by "0.1% or less", then the content of N is widely selective. Usually, the N content is 0.01 to 0.05%, which is one tenth smaller than the C content. Therefore, the properties of steel were investigated on the relationship of the effective solute carbon content (C*) and ten times of the effective solute nitrogen content (N*).

As can be seen in FIG. 1, a delayed fracture in the impact-worked portions (crack) decreases as the content of both of C* and N* decreases. The inequality (1) above is determined by applying a linear interpolation to the result.

An interstitial element such as C and N influences on the work hardening due to a cold working when a steel pipe is subjected to the impact work. In particular, N provides pining of dislocations in order to increase the work hardening. From the experimental results, the inventors found that the work hardening and the delayed fracture due to hydrogen were suppressed remarkably when the amount of "C*+10 N*" is restricted to 0.45 or less.

The delayed fracture of the impact-worked portions is influenced by the hydrogen amount and the hardness of the portions. It is necessary to reduce the effective solute carbon content (C*) and the effective solute nitrogen content (N*) and thereby reduce hardness in order to suppress the generation of cracks. When steel is work-hardened by cold working due to a handling impact, hydrogen cracking is generated even if the initial hardness is low. Accordingly, the amount of residual hydrogen in a steel pipe should be decreased to prevent hydrogen cracking.

The amount of residual hydrogen in an as-rolled steel pipe is different from that in a heat-treated steel pipe. In a 13% Cr steel, there is a correlation between the amount of residual hydrogen in an as-rolled steel pipe and that in a heat-treated steel pipe because a heat treatment temperature is substantially fixed. The quenching temperature is 920 to 980° C. and the tempering temperature is 650 to 750° C.

Figure 2:
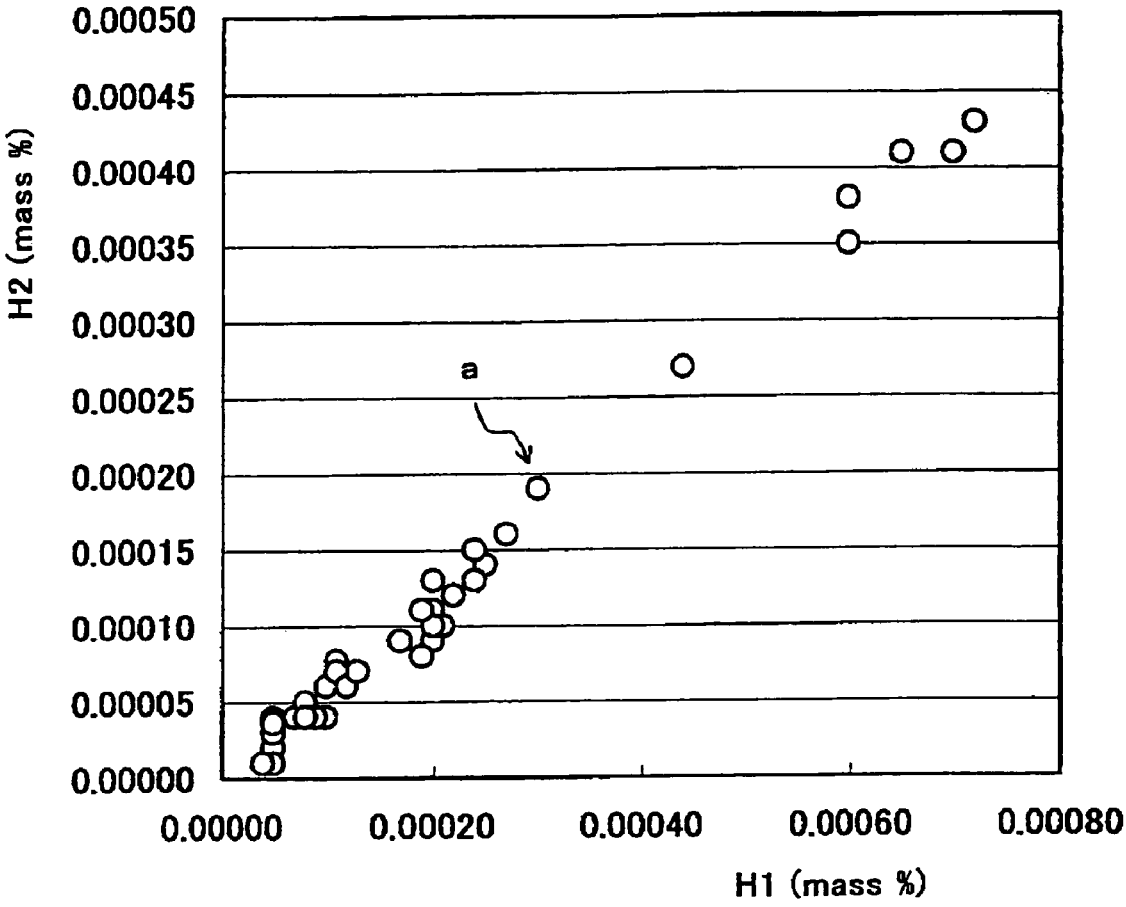
FIG. 2 is a diagram showing the relationship between the amount of residual hydrogen in an as-rolled steel pipe (H1) and that in a heat-treated (H2).

FIG. 2 is a diagram showing the relationship of the amount of residual hydrogen between H1 (as-rolled) and H2 (after heat-treated) regarding the 13% Cr steel pipe used in the EXAMPLES below. For instance, at a point of the sign of ○ marked by "a", the amount of residual hydrogen (H1) in an as-rolled steel pipe was approximately 3 ppm, and the amount of residual hydrogen (H2) after a heat treatment was approximately 2 ppm.

The inequality (2) above restricts the relationship between "C*+10N*" and H1, and the inequality (3) above restricts the relationship between "C*+10N*" and H2. As described above, an increased amount of C* and N* causes an increase in strength and a decrease in toughness, and then increases delayed fracture sensitivity due to hydrogen in the impact-worked portions. As a result, it is necessary to take into account a total relationship of the contents of C* and N* and the amount of residual hydrogen, in order to suppress a delayed fracture.

Figure 3:
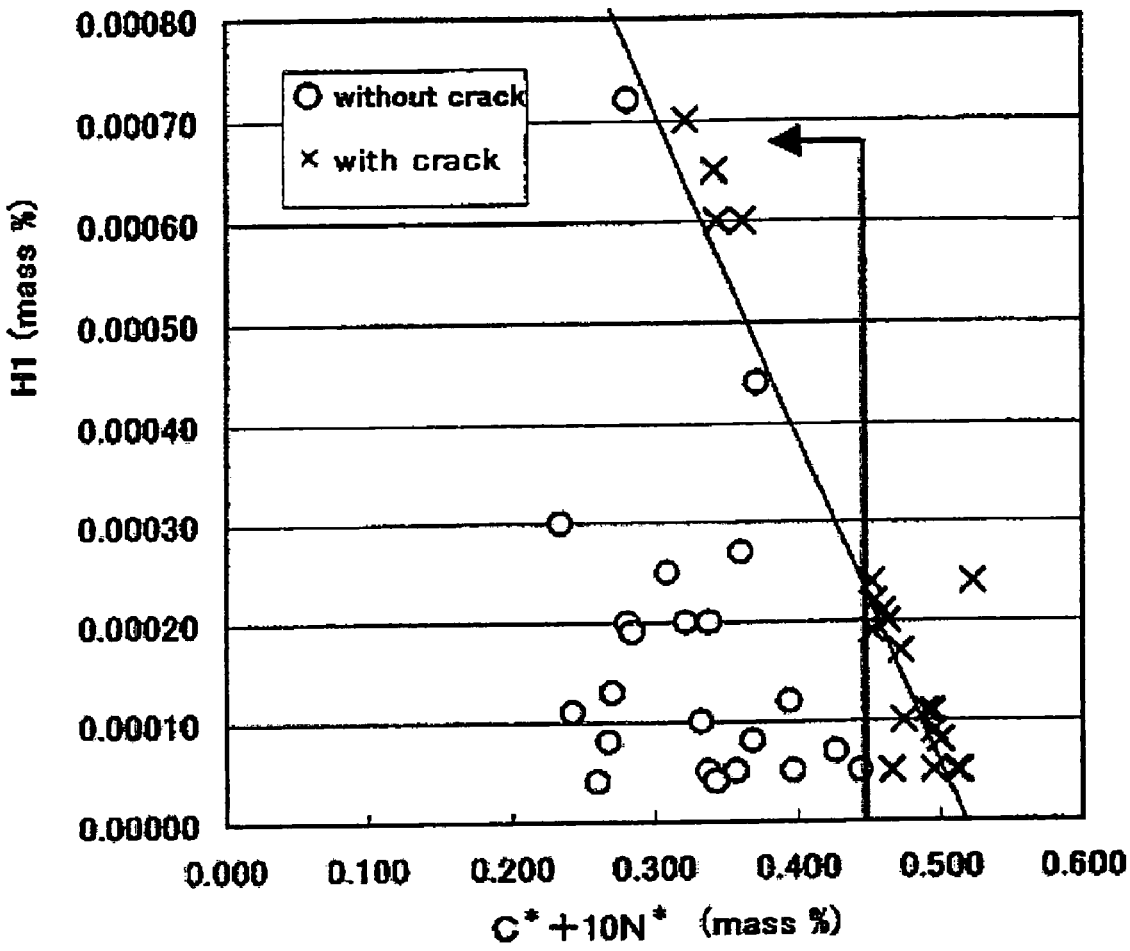
FIG. 3 is a diagram showing the relationship between a crack resulting from a delayed fracture and two parameters: "C*+10N*" and the amount of residual hydrogen in an as-rolled steel pipe (H1).
Figure 4:
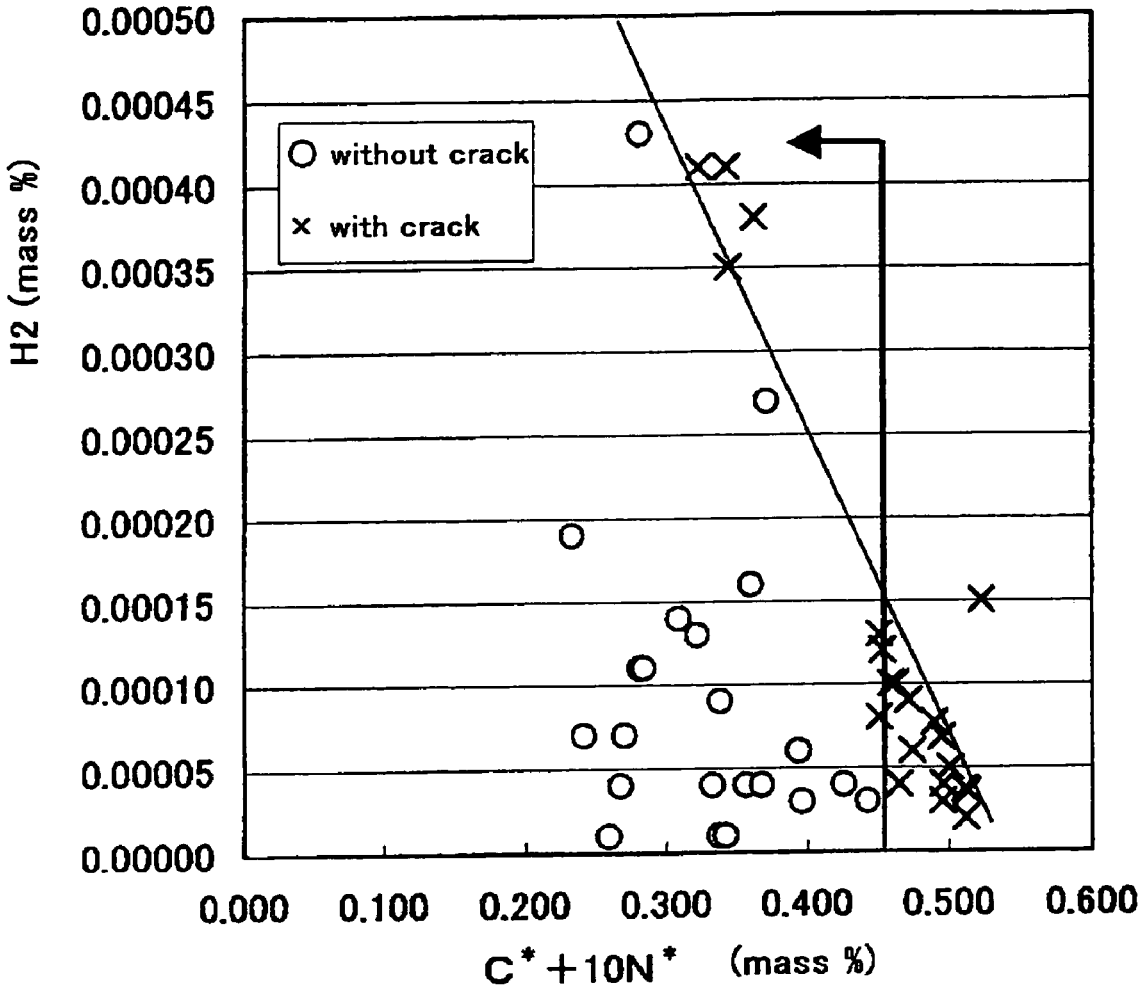
FIG. 4 is a diagram showing the relationship between a crack resulting from a delayed fracture and two parameters, "C*+10N*" and the amount of residual hydrogen in a heat-treated steel pipe (H2).

FIG. 3 shows the result which is obtained by investigating a delayed fracture sensitivity of the impact-worked portions for an as-rolled steel pipe of a 13% Cr martensitic stainless steel having the C content of 0.19% and plotting the results on the correlation of "C*+10N*" and H1. FIG. 4 shows a result of a similar investigation and plots on the correlation of "C*+10N*" and H2 after a heat treatment. These results were obtained in EXAMPLES below.

From the diagrams of FIGS. 3 and 4, it can be recognized that a delayed fracture (crack) is no longer generated in the impact-worked portions if the inequality (1) above and the following inequalities (2) or (3) are satisfied, where H1 is the amount of residual hydrogen in an as-rolled pipe and H2 is the amount of residual hydrogen after a heat treatment:

$$H1 \leqq -0.003\,(C^*+10N^*)+0.0016 \quad (2)$$

$$H2 \leqq -0.0018\,(C^*+10N^*)+0.00096 \quad (3)$$

On the other hand, the inequalities (4) and (5) below represent the ranges of the Cr and S contents effective for suppressing an inner surface defect, which is called an internal scab. The satisfaction of the inequalities (2) and (3) above makes it possible to suppress a delayed fracture in the impact-worked proportions for an as-rolled steel pipe and after a heat treatment. Nevertheless, there is a possibility that an internal scab could be generated in the process of manufacturing a steel pipe.

A generation of an internal scab results from a shear deformation in a circumferential direction in the process of pierce rolling with a piercing mill. The shear strain causes cracks on such a portion that has a different deformation resistance in a billet as ferrite/austenite grain boundaries, segregations of sulfur and inclusions. These cracks deform and cause internal scabs in the course of rolling.

In order to suppress cracks in the ferrite/austenite grain boundaries, the amount of δ ferrite has to be minimized. The amount of δ ferrite depends on the Cr equivalent (Cr*), and in fact, an increase of Cr* causes an increase of ferrite. Cr* can be expressed by the following equation (8), which represents a linear correlation between ferrite-forming elements and austenite-forming elements:

$$Cr^* = Cr+4Si-(22C+0.5Mn+1.5Ni+30N). \quad (8)$$

As can be seen in the equation (8), N provides a significant contribution to Cr*. When the N content is decreased to enhance the toughness of an as-rolled steel pipe, the Cr equivalent increases and the amount of ferrite increases, which causes an internal scab. In view of these facts, the satisfaction of the following inequality (4) suppresses a ferrite and an internal scab:

$$Cr^* \leqq 9.0. \quad (4)$$

A sulfur-segregated portion also becomes an origin of generating a crack. In order to suppress such segregation, it is desirable to minimize S content. For this purpose, S content should be 0.010% or less, and it is preferable that S content is 0.003% or less. It is preferable that the content of oxygen (O) is 0.0060% or less in order to reduce inclusions in steel, macro-streak-flaw and the S content during steel making.

When N* is decreased in order to satisfy the inequality (1) to suppress cracks, Cr* expressed by equation (8) is increased. This causes an increase of the ferrite phase, which causes a reduced hot workability. In order to recover a hot workability, the S content has to be reduced.

Figure 5:
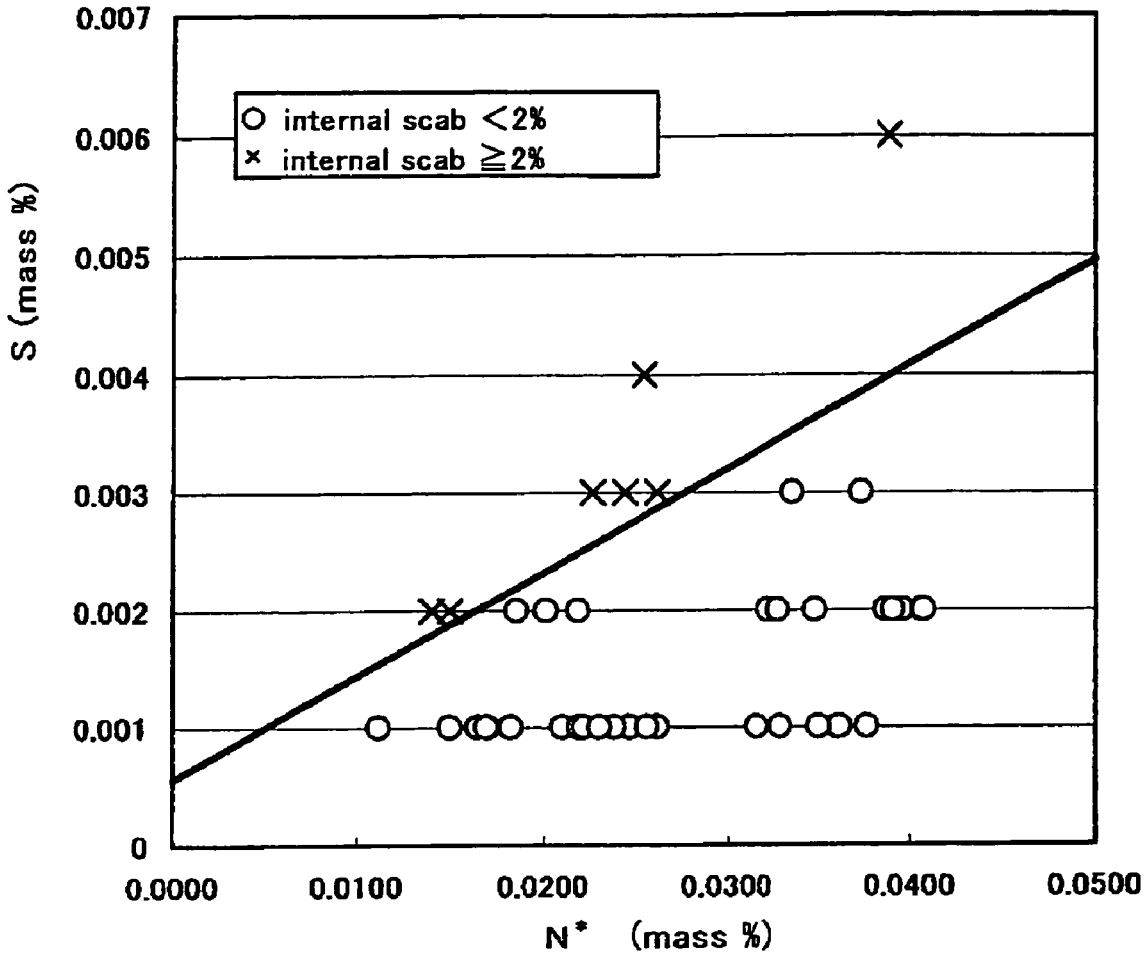
FIG. 5 is a diagram of occurrence of internal scabs in a correlation of effective solute nitrogen content (N*) and sulfur content.

FIG. 5 illustrates a diagram of occurrence of internal scabs less than 2% (shown by a sign of ○) or not less than 2% (shown by a sign of x) in the correlation of N* in abscissa and S content in ordinate. This diagram leads to a recognition that restricting S content by the following inequality (5) suppresses an internal scab. The criteria line is decided to be 2% of an internal scab generation from the viewpoint of work efficiency without interrupting manufacturing.

$$S \leqq 0.088\,N^*+0.00056. \quad (5)$$

3. As for the Manufacturing Method

In the method of manufacturing a seamless steel pipe according to the invention, the steel having the above-mentioned chemical composition and satisfying the inequalities (1), (4) and (5) is pierce-rolled under conditions restricted by the inequality (9) with the aid of a cross roller type piercing mill.

In order to suppress an internal scab during pierce rolling, it is important to select the proper rolling conditions, taking into account the hot workability of the steel to be rolled.

Various factors influence generating internal scabs. Among these factors, feed angle and toe angle of main rollers in a piercing mill play an essential role. Generally, an increase in both a feed angle and a toe angle reduces the additional shear deformation in the process of pierce rolling, and makes it possible to roll the steel without generating cracks even if it has a poor hot workability.

However, feed angle and toe angle cannot always be easily increased. In order to attain an increase in these angles, the replace of a main motor is required, and even a replace of the mill may be required. If the steel has a proper hot workability during rolling, it would be possible to choose a relatively small feed and toe angles. The relationship between an index regarding a hot workability during rolling and an index suppressing an internal scab i.e. an additional shear deformation, can lead to a possible optimal manufacturing conditions of design of material of steel and conditions for pierce rolling from the viewpoint of economy in the manufacturing.

The present inventors researched the past experimental data to investigate the influence of feed and toe angles on the additional shear deformation, and further studied the relationship between the Cr* and the sum of "C.A. (toe angle)+F.A. (feed angle)". As a result, an explicit correlation between Cr* and "C.A.+F.A." was found on the basis that both of feed and toe angles contribute to the same extent to an additional shear stress.

Figure 6:
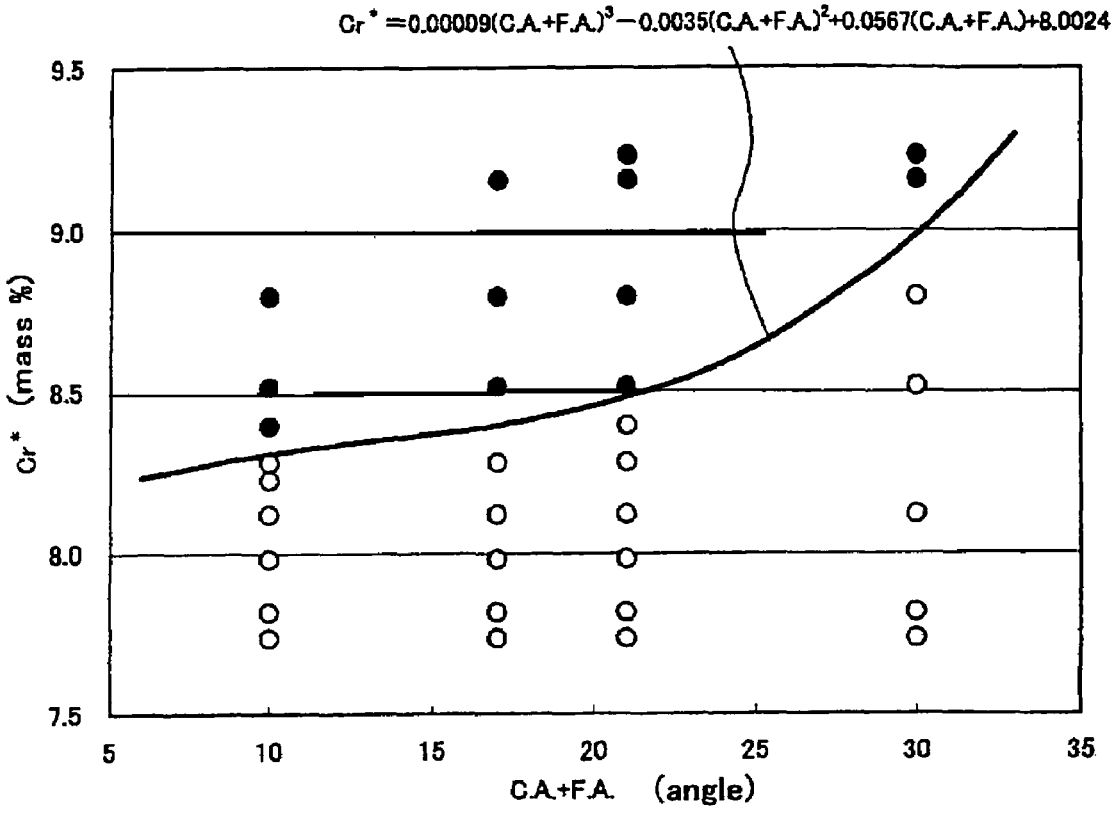
FIG. 6 is a diagram of occurrence of both internal scabs and external defects in correlation of "toe angle (C.A.)+feed angle (F.A.)" and Cr equivalent (Cr*).

FIG. 6 illustrates a diagram of the occurrence of both an internal scab and an external defect less than 2% (shown by ○) or not less than 2% (shown by a sign of ●) in a correlation of "C.A.+F.A." in abscissa and Cr* in ordinate. This map leads to the recognition that a boundary line of whether both an internal scab and an external defect are less than 2% (shown by ○) or not (shown by a sign of ●) can be expressed by the cubic curve. A condition satisfying the following inequality (9) leads to a suppressed generation of internal scabs.

$$Cr^* < 0.00009(C.A.+F.A.)^3 - 0.0035(C.A.+F.A.)^2 + 0.0567(C.A.+F.A.) + 8.0024, \quad (9)$$

where the right side of the inequality (9) is determined by interpolating the obtained data and represents the boundary above.

A manufacturing method according to the invention may include a process of re-heating before finishing rolling wherein a stretch reducer is used. It is preferable, in this case, that soaking is held at a temperature of 920° C. or more during re-heating. A decreased soaking temperature during re-heating causes a reduced toughness of an as-rolled steel in T direction, which is perpendicular to a rolling direction, because of the incomplete recrystallization of flat grains, formed during working. Furthermore, C and N enriched areas are generated around Nb and/or V carbides/nitrides because of the incomplete solid solution or diffusion of the carbides and/or nitrides. Then, a hardening and a brittleness take place in the areas, which cause a delayed fracture. It is preferable that the lower limit of a soaking temperature during re-heating is 920° C., or more preferable 1000° C., and it is preferable that the upper limit of a soaking temperature is 1100° C. or so.

EXAMPLES

Seamless pipes, having a 60.3 mm outer diameter and a 4.83 mm thickness, were produced from 43 kinds of steel having the chemical composition shown in Tables 1 and 2. Then the following tests were carried out for these steel pipes.

(1) Delayed Fracture Test

Drop test pieces having a 250 mm length were prepared from as-rolled steel pipes. A weight test element, having 150 kg weight and a 90 mm curvature at its tip, was dropped from a 0.2 m height onto a test piece, which is deformed under an impact load (294J). After one week each piece was inspected as to whether or not cracks were generated. An inspection of cracks was carried out by a visual check and also by an ultrasonic test (UST). The results are listed in Tables 3 and 4.

FIG. 1 is a diagram showing the relationship between the generated cracks and both effective solute carbon content (C*) and effective solute nitrogen content (N*). As shown in the diagram, a straight line "a" implies a boundary of generating cracks. The straight line "a" can be expressed by "C*+10N*=0.45". Accordingly, the condition of generating no delayed fracture can be expressed by $C^*+10N^* \leqq 0.45$.

(2) Measurement the Amount of Residual Hydrogen (H1 and H2)

The amount of residual hydrogen of an as-rolled steel pipe and the amount of the same after a heat treatment were measured using an analyzing method specified in JIS Z2614. In the heat treatment, a test piece was water-quenched at the temperature of 950° C. and then tempered at 700° C. The results of measurement are listed in Tables 3 and 4.

FIG. 2 is a diagram showing the relationship between H1 and H2 of the test piece. It can be ascertained that there is a linear relationship which can be expressed approximately by "H2=0.6H1".

(3) The Relationship Between a Delayed Fracture and Three Parameters, C*, N* and the Amount of Residual Hydrogen.

The data listed in Tables 3 and 4 regarding whether a delayed fracture was generated or not are represented in the diagram FIG. 3 for an as-rolled steel pipe and in the diagram FIG. 4 for a heat-treated steel pipe, respectively, where the abscissa means "C*+10N*" and the ordinate means the amount of residual hydrogen. The straight lines for the boundaries of whether a crack is generated or not is expressed by the following equations (2)-1 and (3)-1 below, respectively. Accordingly, a condition of generating no delayed fracture is to satisfy the inequalities (2) or (3) above. Moreover, even if the inequalities (2) and (3) are satisfied, there is a possibility that a delayed fracture could take place when "C*+10N*" is more than 0.45. Then, the inequality (1) above should be satisfied.

$$H1 = -0.003(C^*+10N^*) + 0.0016, \quad (2)\text{-}1$$

$$H2 = -0.0018(C^*+10N^*) + 0.00096. \quad (3)\text{-}1$$

TABLE 1

| No. | Chemical composition (the balance: Fe and impurities, mass %) | | | | | | | | | | | | | | | |
|---|---|---|---|---|---|---|---|---|---|---|---|---|---|---|---|---|
| | C | Si | Mn | P | S | Cr | Ni | Cu | V | Al | N | Nb | Ti | B | Ca | O |
| 1 | 0.19 | 0.27 | 0.85 | 0.014 | 0.001 | 12.80 | 0.08 | 0.04 | 0.040 | 0.0013 | 0.035 | 0.001 | 0.003 | 0.0002 | 0.0002 | 0.0020 |
| 2 | 0.18 | 0.29 | 0.89 | 0.015 | 0.002 | 12.70 | 0.14 | 0.02 | 0.030 | 0.0022 | 0.034 | 0.002 | 0.002 | 0.0001 | 0.0003 | 0.0030 |
| 3 | 0.19 | 0.28 | 0.82 | 0.018 | 0.003 | 12.90 | 0.12 | 0.06 | 0.080 | 0.0019 | 0.028 | 0.005 | 0.004 | 0.0003 | 0.0005 | 0.0050 |
| 4 | 0.21 | 0.29 | 0.76 | 0.017 | 0.001 | 12.60 | 0.07 | 0.02 | 0.040 | 0.0008 | 0.028 | 0.003 | 0.001 | 0.0004 | 0.0006 | 0.0040 |
| 5 | 0.20 | 0.31 | 0.72 | 0.016 | 0.002 | 12.60 | 0.34 | 0.11 | 0.090 | 0.0014 | 0.022 | 0.006 | 0.003 | 0.0002 | 0.0008 | 0.0020 |
| 6 | 0.19 | 0.28 | 0.91 | 0.019 | 0.001 | 12.80 | 0.21 | 0.14 | 0.060 | 0.0230 | 0.033 | 0.004 | 0.002 | 0.0005 | 0.0021 | 0.0010 |
| 7 | 0.20 | 0.24 | 0.94 | 0.014 | 0.001 | 12.90 | 0.09 | 0.15 | 0.110 | 0.0240 | 0.021 | 0.003 | 0.001 | 0.0006 | 0.0017 | 0.0030 |
| 8 | 0.21 | 0.27 | 0.88 | 0.018 | 0.002 | 13.10 | 0.34 | 0.12 | 0.080 | 0.0120 | 0.021 | 0.005 | 0.001 | 0.0007 | 0.0018 | 0.0040 |
| 9 | 0.20 | 0.30 | 0.76 | 0.017 | 0.001 | 12.80 | 0.45 | 0.05 | 0.160 | 0.0030 | 0.027 | 0.008 | 0.004 | 0.0002 | 0.0034 | 0.0030 |
| 10 | 0.19 | 0.26 | 0.77 | 0.014 | 0.003 | 13.00 | 0.21 | 0.03 | 0.090 | 0.0150 | 0.030 | 0.009 | 0.003 | 0.0006 | 0.0032 | 0.0050 |
| 11 | 0.18 | 0.27 | 0.82 | 0.017 | 0.001 | 12.80 | 0.26 | 0.02 | 0.050 | 0.0150 | 0.028 | 0.002 | 0.004 | 0.0003 | 0.0016 | 0.0030 |
| 12 | 0.20 | 0.29 | 0.84 | 0.018 | 0.002 | 12.40 | 0.35 | 0.01 | 0.120 | 0.0090 | 0.039 | 0.001 | 0.003 | 0.0002 | 0.0018 | 0.0030 |
| 13 | 0.18 | 0.31 | 0.79 | 0.013 | 0.001 | 12.70 | 0.21 | 0.06 | 0.110 | 0.0050 | 0.041 | 0.001 | 0.002 | 0.0003 | 0.0016 | 0.0030 |
| 14 | 0.20 | 0.30 | 0.83 | 0.016 | 0.003 | 12.80 | 0.27 | 0.13 | 0.080 | 0.0020 | 0.037 | 0.003 | 0.001 | 0.0007 | 0.0018 | 0.0050 |
| 15 | 0.20 | 0.28 | 0.87 | 0.018 | 0.002 | 12.80 | 0.12 | 0.21 | 0.090 | 0.0030 | 0.039 | 0.01 | 0.004 | 0.0002 | 0.0015 | 0.0020 |
| 16 | 0.21 | 0.23 | 0.84 | 0.017 | 0.001 | 12.50 | 0.08 | 0.16 | 0.070 | 0.0090 | 0.037 | 0.015 | 0.003 | 0.0007 | 0.0019 | 0.0010 |
| 17 | 0.20 | 0.27 | 0.78 | 0.018 | 0.002 | 12.80 | 0.04 | 0.22 | 0.130 | 0.0070 | 0.039 | 0.016 | 0.002 | 0.0004 | 0.0006 | 0.0040 |
| 18 | 0.21 | 0.29 | 0.86 | 0.017 | 0.001 | 12.90 | 0.05 | 0.14 | 0.030 | 0.0110 | 0.041 | 0.006 | 0.006 | 0.0002 | 0.0008 | 0.0030 |
| 19 | 0.18 | 0.25 | 0.88 | 0.016 | 0.002 | 12.60 | 0.03 | 0.06 | 0.020 | 0.0070 | 0.044 | 0.009 | 0.005 | 0.0001 | 0.0017 | 0.0030 |
| 20 | 0.19 | 0.27 | 0.76 | 0.016 | 0.001 | 12.80 | 0.06 | 0.05 | 0.040 | 0.0180 | 0.044 | 0.004 | 0.002 | 0.0003 | 0.0024 | 0.0020 |
| 21 | 0.18 | 0.28 | 0.91 | 0.018 | 0.002 | 12.70 | 0.09 | 0.02 | 0.030 | 0.0160 | 0.045 | 0.006 | 0.001 | 0.0002 | 0.0039 | 0.0020 |
| 22 | 0.20 | 0.28 | 0.84 | 0.014 | 0.003 | 12.90 | 0.14 | 0.03 | 0.050 | 0.0150 | 0.043 | 0.002 | 0.002 | 0.0001 | 0.0048 | 0.0020 |
| 23 | 0.20 | 0.27 | 0.89 | 0.018 | 0.001 | 12.60 | 0.19 | 0.12 | 0.050 | 0.0210 | 0.032 | 0.002 | 0.001 | 0.0004 | 0.0025 | 0.0020 |
| 24 | 0.20 | 0.22 | 0.92 | 0.014 | 0.001 | 12.70 | 0.07 | 0.14 | 0.100 | 0.0220 | 0.033 | 0.004 | 0.002 | 0.0005 | 0.0019 | 0.0030 |
| 25 | 0.21 | 0.25 | 0.89 | 0.017 | 0.001 | 13.00 | 0.33 | 0.13 | 0.090 | 0.0110 | 0.021 | 0.004 | 0.002 | 0.0005 | 0.0020 | 0.0050 |

TABLE 2

| No. | Chemical composition (the balance: Fe and impurities, mass %) | | | | | | | | | | | | | | | |
|---|---|---|---|---|---|---|---|---|---|---|---|---|---|---|---|---|
| | C | Si | Mn | P | S | Cr | Ni | Cu | V | Al | N | Nb | Ti | B | Ca | O |
| 26 | 0.20 | 0.28 | 0.79 | 0.015 | 0.002 | 12.90 | 0.42 | 0.04 | 0.150 | 0.0040 | 0.026 | 0.007 | 0.003 | 0.0003 | 0.0032 | 0.0020 |
| 27 | 0.20 | 0.25 | 0.75 | 0.012 | 0.001 | 12.90 | 0.20 | 0.05 | 0.080 | 0.0140 | 0.029 | 0.006 | 0.003 | 0.0007 | 0.0028 | 0.0030 |
| 28 | 0.20 | 0.27 | 0.87 | 0.017 | 0.002 | 12.60 | 0.23 | 0.04 | 0.040 | 0.0120 | 0.027 | 0.004 | 0.004 | 0.0004 | 0.0014 | 0.0010 |
| 29 | 0.21 | 0.27 | 0.88 | 0.016 | 0.001 | 12.80 | 0.07 | 0.12 | 0.020 | 0.0130 | 0.038 | 0.003 | 0.005 | 0.0005 | 0.0004 | 0.0050 |
| 30 | 0.20 | 0.25 | 0.86 | 0.015 | 0.002 | 12.50 | 0.04 | 0.07 | 0.040 | 0.0080 | 0.043 | 0.007 | 0.006 | 0.0002 | 0.0013 | 0.0030 |
| 31 | 0.18 | 0.24 | 0.78 | 0.016 | 0.002 | 12.60 | 0.05 | 0.04 | 0.050 | 0.0150 | 0.045 | 0.003 | 0.003 | 0.0002 | 0.0025 | 0.0020 |
| 32 | 0.18 | 0.28 | 0.92 | 0.017 | 0.002 | 12.50 | 0.07 | 0.05 | 0.040 | 0.0180 | 0.047 | 0.005 | 0.002 | 0.0001 | 0.0031 | 0.0010 |
| 33 | 0.20 | 0.26 | 0.85 | 0.013 | 0.001 | 12.80 | 0.12 | 0.04 | 0.060 | 0.0170 | 0.042 | 0.003 | 0.004 | 0.0003 | 0.0022 | 0.0040 |
| 34 | 0.16 | 0.21 | 0.52 | 0.014 | 0.001 | 13.10 | 0.04 | 0.04 | 0.080 | 0.0018 | 0.029 | 0.002 | 0.003 | 0.0003 | 0.0011 | 0.0030 |
| 35 | 0.18 | 0.27 | 0.38 | 0.017 | 0.002 | 12.90 | 0.05 | 0.03 | 0.040 | 0.0150 | 0.020 | 0.004 | 0.004 | 0.0005 | 0.0008 | 0.0040 |
| 36 | 0.19 | 0.29 | 0.78 | 0.018 | 0.004 | 12.80 | 0.18 | 0.05 | 0.020 | 0.0130 | 0.031 | 0.007 | 0.007 | 0.0007 | 0.0021 | 0.0050 |
| 37 | 0.21 | 0.31 | 0.85 | 0.022 | 0.006 | 12.70 | 0.06 | 0.04 | 0.030 | 0.0030 | 0.041 | 0.005 | 0.002 | 0.0002 | 0.0018 | 0.0020 |
| 38 | 0.21 | 0.27 | 0.88 | 0.013 | 0.003 | 13.00 | 0.14 | 0.03 | 0.080 | 0.0120 | 0.032 | 0.004 | 0.001 | 0.0004 | 0.0009 | 0.0080 |
| 39 | 0.19 | 0.22 | 0.86 | 0.013 | 0.001 | 12.90 | 0.08 | 0.13 | 0.140 | 0.0140 | 0.031 | 0.003 | 0.002 | 0.0002 | 0.0012 | 0.0020 |
| 40 | 0.18 | 0.25 | 0.77 | 0.014 | 0.001 | 12.70 | 0.14 | 0.02 | 0.070 | 0.0220 | 0.025 | 0.003 | 0.005 | 0.0002 | 0.0019 | 0.0020 |
| 41 | 0.18 | 0.26 | 0.74 | 0.012 | 0.001 | 12.90 | 0.19 | 0.02 | 0.110 | 0.0200 | 0.027 | 0.002 | 0.003 | 0.0002 | 0.0024 | 0.0020 |
| 42 | 0.18 | 0.26 | 0.73 | 0.011 | 0.001 | 13.10 | 0.12 | 0.02 | 0.090 | 0.0290 | 0.028 | 0.003 | 0.005 | 0.0004 | 0.0029 | 0.0030 |
| 43 | 0.17 | 0.26 | 0.44 | 0.012 | 0.001 | 13.20 | 0.11 | 0.06 | 0.070 | 0.0022 | 0.020 | 0.004 | 0.002 | 0.0003 | 0.0028 | 0.0040 |

TABLE 3

| No | C* | N* | C* + 10N* | ① | Residual hydrogen as-rolled (H1) | ② | ③ | Residual hydrogen after heat treatment (H2) | ④ | ⑤ | Delayed fracture | Cr* | ⑥ | ⑦ | ⑧ | Internal scab | External scab | Evaluation |
|---|---|---|---|---|---|---|---|---|---|---|---|---|---|---|---|---|---|---|
| 1 | 0.113 | 0.0330 | 0.443 | ○ | 0.00005 | 0.00027 | ○ | 0.000030 | 0.000163 | ○ | ○ | 8.105 | ○ | 0.003463 | ○ | ○ | ○ | ○ |
| 2 | 0.104 | 0.0322 | 0.426 | ○ | 0.00007 | 0.00032 | ○ | 0.000040 | 0.000194 | ○ | ○ | 8.225 | ○ | 0.003395 | ○ | ○ | ○ | ○ |
| 3 | 0.112 | 0.0245 | 0.357 | ○ | 0.00005 | 0.00053 | ○ | 0.000040 | 0.000317 | ○ | ○ | 8.410 | ○ | 0.002713 | X | X | ○ | X |
| 4 | 0.134 | 0.0262 | 0.397 | ○ | 0.00005 | 0.00041 | ○ | 0.000030 | 0.000246 | ○ | ○ | 7.815 | ○ | 0.002870 | ○ | ○ | ○ | ○ |
| 5 | 0.124 | 0.0185 | 0.309 | ○ | 0.00025 | 0.00067 | ○ | 0.000140 | 0.000403 | ○ | ○ | 7.910 | ○ | 0.002189 | ○ | ○ | ○ | ○ |
| 6 | 0.113 | 0.0247 | 0.360 | ○ | 0.00027 | 0.00052 | ○ | 0.000160 | 0.000312 | ○ | ○ | 7.980 | ○ | 0.002735 | ○ | ○ | ○ | ○ |
| 7 | 0.122 | 0.0112 | 0.234 | ○ | 0.00030 | 0.00090 | ○ | 0.000190 | 0.000538 | ○ | ○ | 8.225 | ○ | 0.001544 | ○ | ○ | ○ | ○ |
| 8 | 0.131 | 0.0150 | 0.281 | ○ | 0.00020 | 0.00076 | ○ | 0.000110 | 0.000453 | ○ | ○ | 7.980 | ○ | 0.001882 | X | X | ○ | X |
| 9 | 0.123 | 0.0210 | 0.333 | ○ | 0.00010 | 0.00060 | ○ | 0.000040 | 0.000361 | ○ | ○ | 7.735 | ○ | 0.002408 | ○ | ○ | ○ | ○ |
| 10 | 0.112 | 0.0227 | 0.339 | ○ | 0.00020 | 0.00058 | ○ | 0.000090 | 0.000351 | ○ | ○ | 8.260 | ○ | 0.002556 | X | X | ○ | X |
| 11 | 0.103 | 0.0219 | 0.322 | ○ | 0.00020 | 0.00063 | ○ | 0.000130 | 0.000380 | ○ | ○ | 8.280 | ○ | 0.002490 | ○ | ○ | ○ | ○ |

TABLE 3-continued

| No | C* | N* | C* + 10N* | ① | Residual hydrogen as-rolled (H1) | ② | ③ | Residual hydrogen after heat treatment (H2) | ④ | ⑤ | Delayed fracture | Cr* | ⑥ | ⑦ | ⑧ | Inter-nal scab | Ex-ternal scab | Eval-uation |
|---|---|---|---|---|---|---|---|---|---|---|---|---|---|---|---|---|---|---|
| 12 | 0.125 | 0.0328 | 0.453 | X | 0.00022 | 0.00024 | ○ | 0.000120 | 0.000144 | ○ | X | 7.045 | ○ | 0.003446 | ○ | ○ | ○ | X |
| 13 | 0.104 | 0.0362 | 0.465 | X | 0.00005 | 0.00020 | ○ | 0.000040 | 0.000122 | ○ | X | 8.040 | ○ | 0.003744 | ○ | ○ | ○ | X |
| 14 | 0.123 | 0.0336 | 0.459 | X | 0.00021 | 0.00022 | ○ | 0.000100 | 0.000133 | ○ | X | 7.670 | ○ | 0.003521 | ○ | ○ | ○ | X |
| 15 | 0.123 | 0.0349 | 0.472 | X | 0.00017 | 0.00018 | ○ | 0.000090 | 0.000111 | ○ | X | 7.735 | ○ | 0.003630 | ○ | ○ | ○ | X |
| 16 | 0.135 | 0.0316 | 0.451 | X | 0.00019 | 0.00025 | ○ | 0.000080 | 0.000148 | ○ | X | 7.150 | ○ | 0.003344 | ○ | ○ | ○ | X |
| 17 | 0.123 | 0.0328 | 0.451 | X | 0.00024 | 0.00025 | ○ | 0.000130 | 0.000148 | ○ | X | 7.860 | ○ | 0.003449 | ○ | ○ | ○ | X |
| 18 | 0.132 | 0.0362 | 0.495 | X | 0.00011 | 0.00012 | ○ | 0.000068 | 0.000070 | ○ | X | 7.705 | ○ | 0.003748 | ○ | ○ | ○ | X |
| 19 | 0.104 | 0.0407 | 0.511 | X | 0.00005 | 0.00007 | ○ | 0.000037 | 0.000040 | ○ | X | 7.835 | ○ | 0.004142 | ○ | ○ | ○ | X |
| 20 | 0.113 | 0.0377 | 0.490 | X | 0.00011 | 0.00013 | ○ | 0.000077 | 0.000078 | ○ | X | 7.910 | ○ | 0.003877 | ○ | ○ | ○ | X |
| 21 | 0.104 | 0.0397 | 0.500 | X | 0.00008 | 0.00010 | ○ | 0.000050 | 0.000060 | ○ | X | 7.920 | ○ | 0.004051 | ○ | ○ | ○ | X |
| 22 | 0.122 | 0.0374 | 0.496 | X | 0.00009 | 0.00011 | ○ | 0.000040 | 0.000067 | ○ | X | 7.700 | ○ | 0.003847 | ○ | ○ | ○ | X |
| 23 | 0.124 | 0.0248 | 0.372 | ○ | 0.00044 | 0.00048 | ○ | 0.000270 | 0.000291 | ○ | ○ | 7.590 | ○ | 0.002738 | ○ | ○ | ○ | ○ |
| 24 | 0.124 | 0.0239 | 0.362 | ○ | 0.00060 | 0.00051 | X | 0.000380 | 0.000308 | X | X | 7.625 | ○ | 0.002662 | ○ | ○ | ○ | X |
| 25 | 0.132 | 0.0150 | 0.282 | ○ | 0.00072 | 0.00075 | ○ | 0.000430 | 0.000453 | ○ | ○ | 7.810 | ○ | 0.001881 | ○ | ○ | ○ | ○ |

No. 1, 2, 4-7, 9, 11, 23 and 25: Present Invention
No. 3, 8, 10, 12-22 and 24: Comparative
①: whether the inequality (1) is satisfied(○) or not(X)
②: calculated value of the right side in the inequality (2)
③: whether the inequality (2) is satisfied(○) or not(X)
④: calculated value of the right side in the inequality (3)
⑤: whether the inequality (3) is satisfied(○) or not(X)
⑥: whether the inequality (4) is satisfied(○) or not(X)
⑦: calculated value of the right side in the inequality (5)
⑧: whether the inequality (5) is satisfied(○) or not(X)

TABLE 4

| No | C* | N* | C* + 10N* | ① | Residual hydrogen as-rolled (H1) | ② | ③ | Residual hydrogen after heat treatment (H2) | ④ | ⑤ | Delayed fracture | Cr* | ⑥ | ⑦ | 8 | Inter-nal scab | Ex-ternal scab | Eval-uation |
|---|---|---|---|---|---|---|---|---|---|---|---|---|---|---|---|---|---|---|
| 26 | 0.122 | 0.0201 | 0.323 | ○ | 0.00070 | 0.00063 | X | 0.000410 | 0.000378 | X | X | 7.815 | ○ | 0.002330 | ○ | ○ | ○ | X |
| 27 | 0.122 | 0.0222 | 0.344 | ○ | 0.00060 | 0.00057 | X | 0.000350 | 0.000340 | X | X | 7.955 | ○ | 0.002514 | ○ | ○ | ○ | X |
| 28 | 0.124 | 0.0219 | 0.343 | ○ | 0.00065 | 0.00057 | X | 0.000410 | 0.000342 | X | X | 7.690 | ○ | 0.002487 | ○ | ○ | ○ | X |
| 29 | 0.133 | 0.0330 | 0.463 | X | 0.00020 | 0.00021 | ○ | 0.000100 | 0.000127 | ○ | X | 7.575 | ○ | 0.003463 | ○ | ○ | ○ | X |
| 30 | 0.125 | 0.0387 | 0.512 | X | 0.00005 | 0.00006 | ○ | 0.000020 | 0.000038 | ○ | X | 7.320 | ○ | 0.003967 | ○ | ○ | ○ | X |
| 31 | 0.104 | 0.0391 | 0.495 | X | 0.00005 | 0.00011 | ○ | 0.000030 | 0.000068 | ○ | X | 7.785 | ○ | 0.004003 | ○ | ○ | ○ | X |
| 32 | 0.105 | 0.0408 | 0.513 | X | 0.00005 | 0.00006 | ○ | 0.000036 | 0.000037 | ○ | X | 7.685 | ○ | 0.004151 | ○ | ○ | ○ | X |
| 33 | 0.123 | 0.0351 | 0.474 | X | 0.00010 | 0.00018 | ○ | 0.000060 | 0.000106 | ○ | X | 7.575 | ○ | 0.003651 | ○ | ○ | ○ | X |
| 34 | 0.081 | 0.0257 | 0.338 | ○ | 0.00005 | 0.00059 | ○ | 0.000010 | 0.000352 | ○ | ○ | 9.230 | X | 0.002820 | ○ | X | ○ | X |
| 35 | 0.102 | 0.0141 | 0.243 | ○ | 0.00011 | 0.00087 | ○ | 0.000070 | 0.000523 | ○ | ○ | 9.155 | X | 0.001797 | X | X | ○ | X |
| 36 | 0.113 | 0.0255 | 0.368 | ○ | 0.00008 | 0.00050 | ○ | 0.000040 | 0.000298 | ○ | ○ | 8.190 | ○ | 0.002805 | X | X | ○ | X |
| 37 | 0.134 | 0.0389 | 0.523 | X | 0.00024 | 0.00003 | X | 0.000150 | 0.000019 | X | X | 7.575 | ○ | 0.003984 | X | X | ○ | X |
| 38 | 0.132 | 0.0262 | 0.394 | ○ | 0.00012 | 0.00042 | ○ | 0.000060 | 0.000251 | ○ | ○ | 7.850 | ○ | 0.002868 | X | X | X | X |
| 39 | 0.112 | 0.0231 | 0.343 | ○ | 0.00004 | 0.00057 | ○ | 0.000010 | 0.000343 | ○ | ○ | 8.120 | ○ | 0.002590 | ○ | ○ | ○ | ○ |
| 40 | 0.104 | 0.0165 | 0.268 | ○ | 0.00008 | 0.00080 | ○ | 0.000040 | 0.000477 | ○ | ○ | 8.395 | ○ | 0.002010 | ○ | ○ | ○ | ○ |
| 41 | 0.102 | 0.0182 | 0.284 | ○ | 0.00019 | 0.00075 | ○ | 0.000110 | 0.000448 | ○ | ○ | 8.515 | ○ | 0.002162 | ○ | ○ | ○ | ○ |
| 42 | 0.101 | 0.0170 | 0.271 | ○ | 0.00013 | 0.00079 | ○ | 0.000070 | 0.000472 | ○ | ○ | 8.795 | ○ | 0.002054 | ○ | ○ | ○ | ○ |
| 43 | 0.091 | 0.0170 | 0.260 | ○ | 0.00004 | 0.00082 | ○ | 0.000010 | 0.000492 | ○ | ○ | 9.515 | X | 0.002053 | ○ | X | ○ | X |

No. 39-42: Present Invention
No. 26-38 and 43: Comparative
①: whether the inequality (1) is satisfied(○) or not(X)
②: calculated value of the right side in the inequality (2)
③: whether the inequality (2) is satisfied(○) or not(X)
④: calculated value of the right side in the inequality (3)
⑤: whether the inequality (3) is satisfied(○) or not(X)
⑥: whether the inequality (4) is satisfied(○) or not(X)
⑦: calculated value of the right side in the inequality (5)
⑧: whether the inequality (5) is satisfied(○) or not(X)

(4) Inspection of Internal Scabs

By selecting several kinds of steel in Tables 1 and 2 which have various contents of effective solute of N and sulfur, 500 steel pipes were produced under condition of "C.A.+FA."=9, and were inspected whether an internal scab was generated or not. The result is shown in FIG. 5. The inclined straight line implies a boundary of whether an internal scab generation is less than 2% or not. It can be expressed by the following equation (5)-1. Therefore, an internal scab can be suppressed by satisfying the inequality (5) above.

$$S=0.088N^*+0.00056. \quad (5)\text{-}1$$

By selecting several kinds of steel in Tables 1 and 2, 50 steel pipes which have various Cr equivalent (Cr*) listed in Table 5, were produced from billets under the following conditions, which were inspected to determine whether an internal scab was generated or not:

(1) Heating temperature of billet: 1200 to 1250° C.

(2) Reduction rate of billet diameter at the top of plug: 5.0 to 8.0%

(3) C.A.+F.A.: 10, 17, 21 and 30

Table 5 shows a relationship between an internal scab generation and two parameters, Cr* and "C.A.+F.A.". In Table 5 and FIG. 6, a sign of ○ indicates that both an internal scab and an external scab are less than 2%, and a sign of ● indicates that either an internal scab or an external scab is not less than 2%.

FIG. 6 is a diagram of the results in Table 5 using the parameters, "C.A.+FA." and Cr*. A cubic line in the diagram is expressed by the following equation (9)-1. Accordingly, the condition of suppressing an internal scab generation is to satisfy the inequality (9) above.

$$Cr^*=0.00009(C.A.+F.A.)^3-0.0035(C.A.+F.A.)^2+0.0567(C.A.+F.A.)+8.0024. \quad (9)\text{-}1$$

TABLE 5

| | | C.A. + F.A. | | | |
|---|---|---|---|---|---|
| No. | Cr* | 10 | 17 | 21 | 30 |
| 9 | 7.735 | ○ | ○ | ○ | ○ |
| 4 | 7.815 | ○ | ○ | ○ | ○ |
| 6 | 7.980 | ○ | ○ | ○ | |
| 39 | 8.120 | ○ | ○ | ○ | ○ |
| 7 | 8.225 | ○ | | | |
| 11 | 8.280 | ○ | ○ | ○ | |
| 40 | 8.395 | ● | | ○ | |
| 41 | 8.515 | ● | ● | ● | ○ |
| 42 | 8.795 | ● | ● | ● | ○ |
| 35 | 9.155 | | ● | ● | ○ |
| 34 | 9.230 | | | ● | ● |
| 43 | 9.515 | | | | ● |

INDUSTRIAL APPLICABILITY

A 13% Cr martensitic steel seamless pipe according to the invention prevents a delayed fracture generation when it is subjected to an impact cold working during handling after manufacturing the pipe. This steel pipe has an excellent corrosion resistance and is particularly available for oil well. A 13% Cr martensitic seamless steel pipe can be produced without an internal scab generation according to a manufacturing method of the invention.

The invention claimed is:

1. A martensitic stainless steel seamless pipe, characterized by consisting of, by mass %, C: 0.15 to 0.22%, Si: 0.1 to 1.0%, Mn: 0.10 to 1.00%, Cr: 12.00 to 14.00%, P: 0.020% or less, S: 0.010% or less, N: 0.05% or less, O (Oxygen): 0.0060% or less, Al: 0 to 0.1%, Ni: 0 to 0.5%, Cu: 0 to 0.25%, Ca: 0 to 0.0050% and at least one element selected from at least one group mentioned below (in total 0.005 to 0.200 mass % in case of including two or more kinds of these elements), and the balance Fe and impurities:

the first group: V: 0.005 to 0.200%, Nb; 0.005 to 0.200%, and Ti: 0.005 to 0.200 mass %, respectively, the second group: B: 0.0005 to 0.0100 mass %, and also characterized by satisfying either the following inequalities (1), (2), (4) and (5) or the following inequalities (1), (3), (4) and (5):

$$C^*+10\,N^*\leqq 0.45, \quad (1)$$

$$H1\leqq -0.003(C^*+10N^*)+0.0016, \quad (2)$$

$$H2\leqq -0.0018(C^*+10N^*)+0.00096, \quad (3)$$

$$Cr^*\leqq 9.0, \quad (4)$$

$$S\leqq 0.088N^*+0.00056, \quad (5)$$

wherein C* is an effective solute carbon content (mass %) defined by the following equation (6), N* is an effective solute nitrogen content (mass %) defined by equation (7), and Cr* is a Cr equivalent defined by equation (8), H1 of inequality (2) is the amount (mass %) of residual hydrogen in an as-rolled steel pipe, and H2 of inequality (3) is the amount (mass %) of residual hydrogen in the steel pipe after a heat treatment, and a symbol of element in each equation or inequality is a content (mass %) of the respective element:

$$C^*=C-[12\{(Cr/52)\times(6/23)\}/10], \quad (6)$$

$$N^*=N-[14\{(V/51)+(Nb/93)\}/10]-[14\{(Ti/48)+(B/11)+(Al/27)\}/2], \quad (7)$$

$$Cr^*=Cr+4Si-(22C+0.5Mn+1.5Ni+30N) \quad (8).$$

2. A martensitic stainless steel seamless pipe according to claim 1, wherein the C content is 0.18 to 0.21%, the Si content is 0.20 to 0.35%, the Cr content is 12.40 to 13.10%, the S content is 0.003% or less, and the N content is 0.035% or less, by mass.

3. A method for manufacturing a martensitic stainless steel seamless pipe, characterized by pierce-rolling a stainless steel with an inclined roller type piercing mill under conditions of satisfying the inequality (9) below, which consists of, by mass %, C: 0.15 to 0.22%, Si: 0.1 to 1.0%, Mn: 0.10 to 1.00%, Cr: 12.00 to 14.00%, P: 0.020% or less, S: 0.010% or less, N: 0.05% or less, O (Oxygen): 0.0060% or less, Al: 0 to 0.1%, Ni: 0 to 0.5%, Cu: 0 to 0.25%, Ca: 0 to 0.0050% and at least one alloying element selected from at least one group mentioned below (in total 0.005 to 0.200 mass % in case of including two or more kinds of these alloying elements), and the balance Fe and impurities:

the first group: V: 0.005 to 0.200%, Nb: 0.005 to 0.200%, and Ti 0.005 to 0.200 mass %, respectively, the second group: B; 0.0005 to 0.0100 mass %, and which also satisfies all the following inequalities (1), (2), (4) and (5)or the following inequalities (1), (3), (4) and (5):

$$C^*+10N^*\leqq 0.45, \quad (1)$$

$$H1\leqq -0.003(C^*+10N^*)+0.0016, \quad (2)$$

$$H2\leqq -0.0018(C^*+10N^*)+0.00096, \quad (3)$$

$$Cr^*\leqq 9.0, \quad (4)$$

$$S\leqq 0.088N^*+0.00056, \quad (5)$$

$$Cr^*<0.00009(C.A.+F.A.)^3-0.0035(C.A.+F.A.)^2+0.0567(C.A.+F.A.)+8.0024 \quad (9)$$

wherein C* is an effective solute carbon content (mass %) defined by the following equation (6), N* is an effective solute nitrogen content (mass %) defined by equation (7), and Cr* is a Cr equivalent defined by equation (8), C.A. (≧0°) and F.A. in inequality (9) express a toe angle and a feed angle, respectively, and a symbol of element in each equation or inequality represents a content (mass %) of the respective element:

$$C^*=C-[12\{(Cr/52)\times(6/23)\}/10], \quad (6)$$

$$N^*=N-[14\{(V/51)+(Nb/93)\}/10]-[14\{(Ti/48)+(B/11)+(Al/27)\}/2], \quad (7)$$

$$Cr^*=Cr+4Si-(22C+0.5Mn+1.5Ni+30N) \quad (8).$$

4. A method for manufacturing a martensitic stainless steel seamless pipe according to claim 3, wherein the C content is 0.18 to 0.21%, the Si content is 0.20 to 0.35%, the Cr content is 12.40 to 13.10%, the S content is 0.003% or less, and the N content is 0.035% or less, by mass.

5. A method for manufacturing a martensitic stainless steel seamless pipe according to claim 3, characterized by further comprising of the following steps (10) and (11) after pierce-rolling:

(10) soaking a pipe at a temperature 920° C. or more, and

(11) carrying out a hot rolling.

6. A method for manufacturing a martensitic stainless steel seamless pipe according to claim 4, characterized by further comprising of the following steps (10) and (11) after pierce-rolling:

(10) soaking a pipe at a temperature 920° C. or more, and

(11) carrying out a hot rolling.

* * * * *

UNITED STATES PATENT AND TRADEMARK OFFICE

CERTIFICATE OF CORRECTION

PATENT NO. : 7,686,897 B2
APPLICATION NO. : 11/030107
DATED : March 30, 2010
INVENTOR(S) : Kidani et al.

It is certified that error appears in the above-identified patent and that said Letters Patent is hereby corrected as shown below:

Column 16, line 47:
"also satisfies all the following inequalities (1), (2), (4)"
should read:
"also satisfies either the following inequalities (1), (2), (4)"

Signed and Sealed this

Fifteenth Day of June, 2010

David J. Kappos

David J. Kappos
*Director of the United States Patent and Trademark Office*